US005687916A

United States Patent [19]

Romano, III et al.

[11] Patent Number: 5,687,916

[45] Date of Patent: Nov. 18, 1997

[54] METHOD OF NONWOVEN RECLAIM

[75] Inventors: Lawrence James Romano, III, Marietta; Stephen Harding Primm, Cumming, both of Ga.

[73] Assignee: Kimberly-Clark Worldwide, Inc., Neenah, Wis.

[21] Appl. No.: 554,177

[22] Filed: Nov. 6, 1995

[51] Int. Cl.[6] ..... B02C 19/00

[52] U.S. Cl. ..... 241/1; 241/301

[58] Field of Search ..... 241/1 L, 1, 301 L, 241/301; 83/53, 177

[56] References Cited

U.S. PATENT DOCUMENTS

| | | | |
|---|---|---|---|
| 3,230,584 | 1/1966 | Kalwaites . | |
| 3,338,992 | 8/1967 | Kinney . | |
| 3,341,394 | 9/1967 | Kinney . | |
| 3,502,538 | 3/1970 | Petersen . | |
| 3,502,763 | 3/1970 | Hartmann . | |
| 3,542,615 | 11/1970 | Dobo et al. . | |
| 3,640,163 | 2/1972 | Giardini et al. . | |
| 3,692,618 | 9/1972 | Dorschner et al. . | |
| 3,802,817 | 4/1974 | Matsuki et al. . | |
| 3,849,241 | 11/1974 | Butin et al. . | |
| 3,996,825 | 12/1976 | Terry . | |
| 4,007,652 | 2/1977 | Shinomiya et al. . | |
| 4,048,885 | 9/1977 | Miyakita et al. . | |
| 4,154,648 | 5/1979 | Osterberg et al. . | |
| 4,274,318 | 6/1981 | Passafiume et al. | 83/177 |
| 4,340,563 | 7/1982 | Appel et al. . | |
| 4,413,965 | 11/1983 | Kinoshita et al. . | |
| 4,567,796 | 2/1986 | Kloehn et al. . | |
| 4,573,382 | 3/1986 | Kloehn et al. . | |
| 5,108,820 | 4/1992 | Kaneko et al. . | |
| 5,108,827 | 4/1992 | Gessner . | |
| 5,116,363 | 5/1992 | Romweber et al. . | |
| 5,234,172 | 8/1993 | Chupka et al. | 241/1 L X |
| 5,303,826 | 4/1994 | Buzga . | |
| 5,336,552 | 8/1994 | Strack et al. . | |
| 5,382,400 | 1/1995 | Pike et al. . | |
| 5,399,174 | 3/1995 | Yei et al. . | |
| 5,412,881 | 5/1995 | Romweber et al. . | |

FOREIGN PATENT DOCUMENTS

| | | |
|---|---|---|
| 063110 | 3/1989 | Japan . |
| 182891 | 7/1994 | Japan . |

*Primary Examiner*—Mark Rosenbaum
*Attorney, Agent, or Firm*—William D. Herrick

[57] ABSTRACT

The present invention provides a method for reducing a nonwoven fabric to flakes which can be recycled into the spinning system of a meltblowing, spunbonding or carding process. The process according to this invention is a non-contact one, involving the use of a hot air knife. The hot air knife emits a jet, or stream, of heated air under pressure at a high flow rate. A nonwoven fabric is contacted with the jet of air and as a consequence, the nonwoven web is physically broken into small pieces, or flakes. The resultant flakes are brushed off the conveyor and collected in a reclaim hopper; they are readily reprocessable due to their small size.

17 Claims, 2 Drawing Sheets

METHOD OF NONWOVEN RECLAIM

FIELD OF THE INVENTION

This invention relates to an apparatus and method of reducing a nonwoven fabric to flakes which can be recycled into the spinning system for further use in the production of nonwoven webs.

BACKGROUND OF THE INVENTION

Nonwoven fabrics or webs constitute all or part of numerous commercial products such as adult incontinence products, sanitary napkins, disposable diapers and hospital gowns. Nonwoven fabrics or webs have a physical structure of individual fibers, strands or threads which are interlaid, but not in a regular, identifiable manner as in a knitted or woven fabric. The fibers may be continuous or discontinuous, and are frequently produced from thermoplastic polymer or copolymer resins from the general classes of polyolefins, polyesters and polyamides. Examples of such polymers include polypropylene, poly(ethylene terephthalate) and nylon-6,6. Blends of polymers or conjugate multicomponent fibers may also be employed. Methods and apparatus for forming fibers and producing a nonwoven web from synthetic fibers are well known; common techniques include meltblowing, spunbonding and carding.

Nonwoven fabrics may be used individually or in composite materials as in a spunbond/meltblown (SM) laminate or a three-layered spunbond/meltblown/spunbond (SMS) fabric. They may also be used in conjunction with films and may be bonded, embossed, treated or colored. Colors may be achieved by the addition of an appropriate pigment to the polymeric resin. In addition to pigments, other additives may be utilized to impart specific properties to a fabric, such as in the addition of a fire retardant to impart flame resistance or the use of inorganic particulate matter to improve porosity. Because they are made from polymer resins such as polyolefins, nonwoven fabrics are usually extremely hydrophobic. In order to make these materials wettable, surfactants can be added internally or externally. Furthermore, additives such as wood pulp or fluff can be incorporated into the web to provide increased absorbency and decreased web density. Such additives are well known in the art. Bonding of nonwoven fabrics can be accomplished by a variety of methods typically based on heat and/or pressure, such as through air bonding and thermal point bonding. Ultrasonic bonding, hydroentangling and stitchbonding may also be used. There exist numerous bonding and embossing patterns that can be selected for texture, physical properties and appearance.

Qualities such as strength, softness, elasticity, absorbency, flexibility and breathability are readily controlled in making nonwovens. However, certain properties must often be balanced against others. An example would be an attempt to lower costs by decreasing fabric basis weight while maintaining reasonable strength. Nonwoven fabrics can be made to feel cloth-like or plastic-like as desired. The average basis weight of nonwoven fabrics for most applications is generally between 5 grams per square meter and 300 grams per square meter, depending on the desired end use of the material.

Nonwoven fabrics have been used in the manufacture of personal care products such as disposable infant diapers, children's training pants, feminine pads and incontinence garments. Nonwoven fabrics are particularly useful in the realm of such disposable absorbent products because it is possible to produce them with desirable cloth-like aesthetics at a low cost. Nonwoven personal care products have had wide consumer acceptance. The elastic properties of some nonwoven fabrics have allowed them to be used in form-fitting garments, and their flexibility enables the wearer to move in a normal, unrestricted manner. This combination of properties has also been utilized in materials designed for treating injuries; an instance of such a commercially available product is Kimberly-Clark's Flexus™ wrap. This wrap is effective in providing support for injuries without causing discomfort or complete constriction. The SM and SMS laminate materials combine the qualities of strength, vapor permeability and barrier properties; such fabrics have proven ideal in the area of protective apparel. Sterilization wrap and surgical gowns made from such laminates are widely used because they are medically effective, comfortable and their cloth-like appearance familiarizes patients to a potentially alienating environment.

One of the practical consequences of the manufacture of virtually all consumer products is the creation of waste. Waste reduction must be addressed for both environmental and economic reasons. In the course of the production of usable nonwoven fabrics, waste rolls of fabric result from research pursuits, optimization of process parameters, edge trim, making an off-specification product, and machine start-up. It would be ideal from both economic and environmental perspectives if waste rolls could be recycled into the fiber spinning system. In general, recycling, or reclaim, of nonwoven fabric requires the web to be broken or cut into smaller, more processable portions at some point in the process.

Numerous cutting mechanisms have been employed for cutting sheet materials, depending on the nature of the material and the path to be cut. One of the more recent developments has been the use of high pressure fluids. U.S. Pat. No. 3,230,584 assigned to Kalwaites discloses a method of converting a fibrous mat to unitary strands or threads based on pneumatic principles, but makes no mention of cuttings being used for recycling purposes. The intent of this method is to produce strong threads from a preferably oriented mat for use in textile fabricating operations. U.S. Pat. No. 3,996,825 assigned to Terry describes a method of cutting a nonwoven mat. The application includes an apparatus for continuously cutting or separating a moving, wet nonwoven fibrous mat resting on a foraminous surface, consisting of a source of high pressure fluid and two nozzles, one above the mat and one below the mat, in communication with the source. One of the nozzles is positioned at an angle to the other. U.S. Pat. No. 4,154,648 assigned to Osterberg et al. specifies a method involving low pressure water or air jets in the separation of a paper web from a forming fabric in a paper-making machine. Furthermore, U.S. Pat. No. 4,048,885 to Miyakita et al. and U.S. Pat. No. 4,007,652 to Shinomiya et al. also describe devices based on high pressure fluids. The hot air knife (HAK) utilized in the present invention is known and illustrated in a variety of patents, including U.S. Pat. No. 4,567,796 issued to Kloehn et al. in which the HAK serves to follow a programmed path in order to cut out shapes needed for a particular purpose, such as the leg holes in a disposable diaper. Copending and coassigned U.S. application Ser. No. 08/362328 to Arnold et al. filed Dec. 22, 1994 is directed towards the use of a HAK to increase the integrity of a spunbonded web. U.S. application Ser. No. 08/362328 provides an improvement over previous compaction processes.

Conventional granulation of nonwoven webs is a costly, multi-step process of grinding and rapelletizing, involving expensive, high maintenance parts such as dies and chopper blades. The invention disclosed here is directed towards an improved method of nonwoven reclaim.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The term also includes films that have been perforated or otherwise treated to allow air to pass through. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 micron to about 50 microns, or more particularly, microfibers may have an average diameter of from about 2 microns to about 40 microns.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al. Spunbond fibers are quenched and generally not tacky when they are deposited onto a collecting surface. Spunbond fibers are generally continuous and have average diameters larger than 7 microns, often between about 10 and 20 microns.

As used herein the term "spunbonded fabric" refers to a nonwoven mat comprised of spunbonded fibers.

As used herein the term "meltblown fibers" means fibers formed by extruding a molten thermoplastic material through a plurality of fine, usually circular, die capillaries as molten threads or filaments into converging high velocity heated gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin. Meltblown fibers are microfibers which may be continuous or discontinuous, are generally smaller than 10 microns in diameter, and are generally selfbonding when deposited onto a collecting surface.

As used herein the term "meltblown fabric" refers to a nonwoven mat being comprised of meltblown fibers.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

As used herein, the term "machine direction" or MD means the length of a fabric in the direction in which it is produced. The term "cross machine direction" or CD means the width of fabric, i.e. a direction generally perpendicular to the MD.

As used herein the term "bicomponent" refers to fibers which have been formed from at least two polymers extruded from separate extruders but spun together to form one fiber. Bicomponent fibers are also sometimes referred to as multicomponent or conjugate fibers. The polymers am usually different from each other though bicomponent fibers may be made from fibers of the same polymer. The polymers are arranged in substantially constantly positioned distinct zones across the cross-section of the bicomponent fibers and extend continuously along the length of the conjugate fibers. The configuration of such a bicomponent fiber may be, for example, a sheath/core arrangement wherein one polymer is surrounded by another or may be a side by side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead they usually form fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, on pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein the term "flake" refers to a portion of a nonwoven fabric whose dimensions are roughly given by an average equivalent diameter of 1/16 to 1/8 inch (1.6 to 3.2 mm), and an average thickness which may range from 1/3000 to 1/10,000 inch (1/118 to 1/394 mm). The diameter as given is only approximate, as such a flake may not be circular, but irregularly shaped. Furthermore, flakes can have a wide range of irregular and regular shapes. The thickness of the flake depends on the thickness of the initial mat, which is contingent upon the desired end use of the mat.

As used herein the term "hot air knife" or "HAK" refers to a device through which a stream of heated air under pressure can be emitted and directed. With such a device, it is also possible to control the air flow of the resultant jet of heated air. The hot air knife is described in coassigned U.S. application Ser. No. 08/362328 filed Dec. 22, 1994 and U.S. Pat. No. 4,567,796 issued Feb. 4, 1986; both application and patent are hereby incorporated by reference in their entireties. The hot air knife is also described in the present application.

As used herein, the term "composite" or "composite material" refers to a material which is comprised of one or more layers of nonwoven fabric combined with one or more other fabric or film layers. The layers are usually selected for the different properties they will impart to the overall composite. The layers of such composite materials are usually secured together through the use of adhesives, entanglement or bonding with heat and/or pressure.

SUMMARY OF THE INVENTION

In order to avoid the equipment breakage and mechanical failure associated with the current practice of nonwoven reclaim, the inventors of the present invention have developed a noncontact method of reclaim. The present invention can be described as noncontact because it does not require the interaction of the nonwoven material with any force other than air or other fluid used. This is desirable from an economic perspective; the present invention is a single step process and does not require any of the costly parts such as chopper blades and dies which are subject to mechanical failure and wear out with use.

The apparatus and method of the present invention are implemented by providing a conveyor continuously transporting a length of nonwoven material, a hot air knife (HAK) in communication with a source of air and positioned above the moving nonwoven material, and a jet of heated air ejected from the HAK under pressure at a high flow rate. As the fabric moves underneath the HAK, it is contacted with the jet of air at an angle within 15° of perpendicular to the web. As a consequence of the thermal energy imparted by the combination of temperature, pressure and high flow rate of the air jet, the nonwoven web is melted and flattened, separating it into small pieces, or flakes. The resultant flakes can be brushed off the conveyor and collected in a reclaim hopper. The resultant flakes are readily reprocessable due to their small size. The size of such flakes is typically 1/16 to 1/8 inches (1.6 to 3.2 mm) in average equivalent diameter, and they have an average thickness which may range from 1/3000 to 1/10,000 inches (1/118 to 1/394 mm). The thickness of the flake depends on the thickness of the initial mat, which is contingent upon the desired end use of the mat. The flakes can then be incorporated without first being pelletized with first-use polymer pellets and reused in the spinning system to form a new nonwoven mat. Both the mat from which the flakes are made and the new mat can be formed from any conventional methods such as meltblowing, spunbonding and carding techniques. Furthermore, the method used to produce the mat from which the flakes are made does not dictate, or place any restrictions on, the method used to form the new mat.

DETAILED DESCRIPTION OF THE INVENTION

As discussed above, the present invention provides a method for reducing a nonwoven fabric to flakes. In the course of producing consumer products from nonwoven fabrics, waste is created as a byproduct. It is desirable from both economic and environmental perspectives that such waste, or reclaim, material be recycled. The resultant flakes of this invention can be readily incorporated into the spinning system in the fiber forming step of nonwoven production; thus, potentially lost material can be recovered and employed to a useful end.

The nonwoven fabrics to which the present invention is directed are particularly useful for making absorbent personal care items, medical products, protective garments and cleaning products. Personal care products include disposable infant diapers, child training pants and feminine and incontinence pads. Protective workwear and medical products include surgical gowns, sterile wrap and wound dressings. Cleaning applications for nonwoven fabrics include wipes and durable towels. Further uses of nonwoven fabrics are varied and well known.

This invention functions through the use of a hot air knife (HAK) which forces hot air through the web and carrier wire with a vacuum assist and physically reduces a nonwoven mat into small pieces, or flakes. The HAK is a device which supplies a stream of heated air under pressure at high flow rates; when a nonwoven mat or other material is subjected to such a fluid jet, the force of the air causes the material to soften and the velocity flattens the "balls" of molten polymer, resulting in flakes.

A wide variety of nonwoven fabrics are suitable to practice the present invention such as those produced using the methods of spunbonding, meltblowing and carding. Composite materials or laminates made from nonwovens can also be handled. In an alternative embodiment, films which are perforated or broken so as to permit air flow through them may be reduced to flakes. Spunbonded, meltblown and carded webs may be made from numerous thermoplastic polymers known to those skilled in the art. Such polymers include those belonging to the general classes of polyolefins, polyesters, polyamides, polyurethanes and mixtures thereof. Examples of such polymers include polypropylene, poly(ethylene terephthalate) and nylon-6,6. In a preferred embodiment of this invention, the reclaim fabric is made only of one type of polymer; however, nonwoven fabrics comprised of bicomponent and biconstituent fibers may also be reduced to flakes using the present invention. For example, flakes made from a nonwoven fabric comprised of biconstituent or bicomponent fibers can be reused to make biconstituent fibers.

Figure 1:
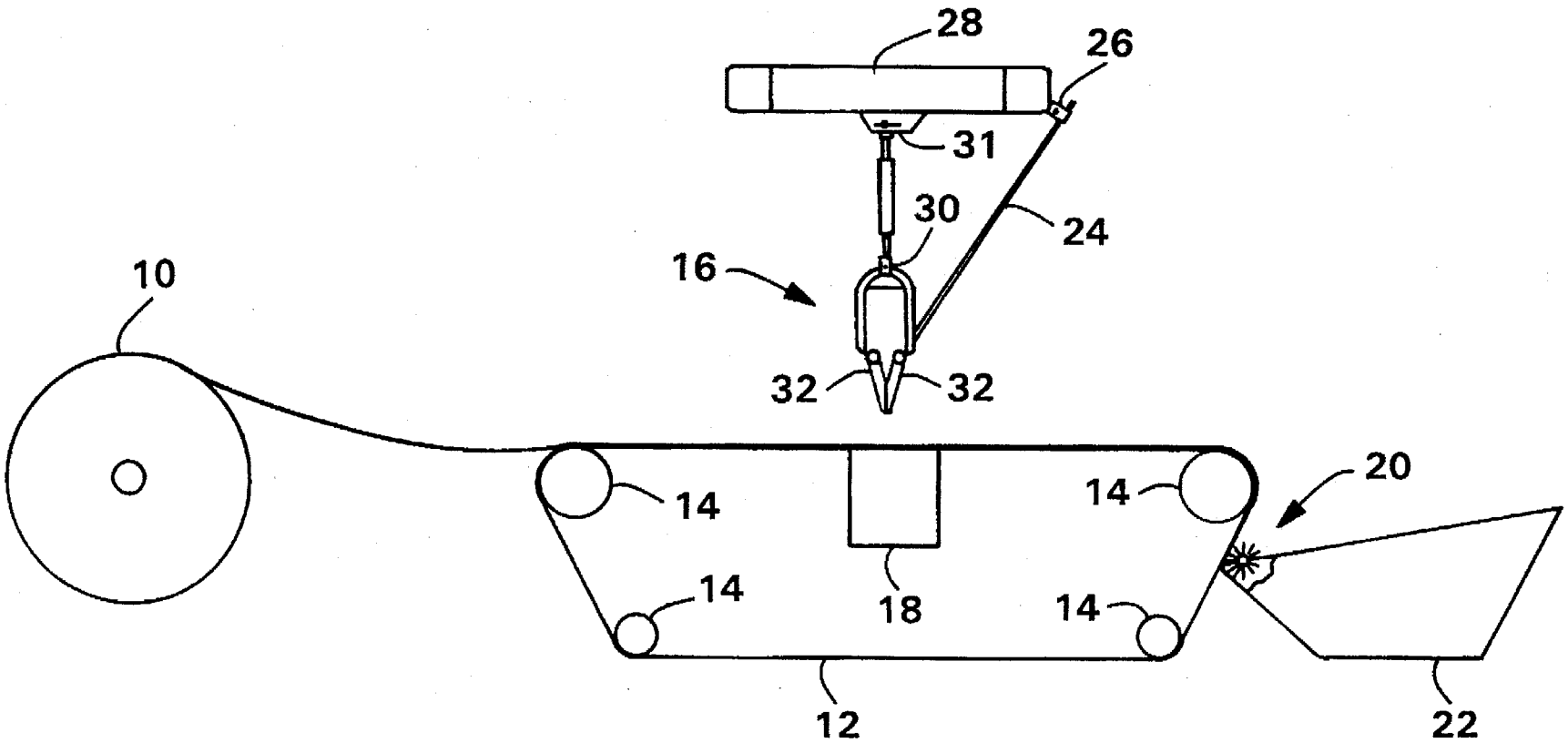
FIG. 1 illustrates a schematic view of an apparatus by which a nonwoven mat can be reduced to flakes.

Referring to FIG. 1, there is schematically illustrated an embodiment of the apparatus and general process to which this invention relates. In the first step of the process, a reclaim roll of nonwoven material 10 is fed onto a carrier wire or transfer belt 12, which can be likened to a short forming wire. As such, the transfer belt may be made of any type of foraminous wire which provides support and is open enough to permit desired air flow through nonwoven 10. Such wires are well known in the art of making nonwoven fabrics.

The carrier wire or transfer belt moves continuously on guide or support rollers 14, thus serving to transport the nonwoven fabric under the HAK 16. Support arm 24 attached to HAK 16 pivots about pin 26 attached to support 28 to adjust the angle of HAK 16 with respect to fabric 10. HAK 16 pivots about points 30 and 31 and other points as will be apparent to those skilled in the art. The HAK supplies a jet of heated air at a high flow rate directly below the HAK and onto the nonwoven fabric. In order to achieve the desired results and minimize heat loss the jet is directed at an angle within 15° of perpendicular and preferably within 5° to 10° of perpendicular to the nonwoven. A vacuum box 18 is located underneath the forming wire below the HAK in order to aid in drawing air through the nonwoven fabric. The combination of vacuum and air flow from the HAK is maintained sufficient to provide flow through the web and transfer heat throughout the web. Air flow rate and velocity may be changed by adjusting the separation between nozzle lips 32. After being contacted with the heated air from the HAK, the nonwoven fabric 10 is reduced to flakes. After initially being contacted with the heated air jet from the HAK, the flakes are slightly tacky. The flakes appear much like a powder and adhere to the transfer belt until they are removed by the action of a scrubber roll or brush 20. By the time the flakes reach the scrubber roll, they have cooled and all the flakes can be removed from the carrier wire without damaging the carrier wire. The scrubber roll consists of abrasive bristles, and can be likened to a brush. The scrubber roll rotates continuously against the moving transfer belt in the opposite direction to the transfer belt. Lastly, the process line described in FIG. 1 provides a hopper 22 for the collection of flakes. Flakes scrubbed off of the transfer belt fall into the hopper.

The HAK must provide sufficient thermal energy to break the nonwoven fabric into flakes. This is accomplished by controlling the temperature, mass flow rate, velocity and pressure of the air jet for a given web polymer, basis weight and fiber size as well as the vacuum from box 18 and the web line speed. The HAK discharge velocity and distance from the web are two variables that can be used to control these factors. The air supplied by the HAK is typically heated to a temperature at or near the melting point of the thermoplastic polymer resin depending on the combination of factors mentioned above. This temperature also depends on the type of polymer used in the nonwoven mat, but may be within the region within 0° to 300° F. (−18° C. to 149° C.), preferably 0° to 130° F. (−18°C. to 54° C.), more preferably 30° F. to 80° F. (17° C. to 44° C.) above its melting point; for example, with polypropylene 200° to 550° F. (93° to 290° C.). Preferably, for polypropylene-based nonwovens, for example, the temperature is within the range 320° to 450° F. (160° to 232° C.). The HAK may supply air at temperatures above the melting point of the polymer; however, melting of the polymer is avoided by controlling the flow rate of the heated air and the duration of the exposure of the mat to such air. In usual practice the stream, or jet, of hot air is emitted from the HAK at a very high flow rate, generally from about 1,000 to 12,000 feet per minute (305 to 3,658 meters per minute). Preferably, the flow rate is in the range of about 7,000 to 10,000 feet per minute (2,136 to 3,048 meters per minute).

Figure 2:
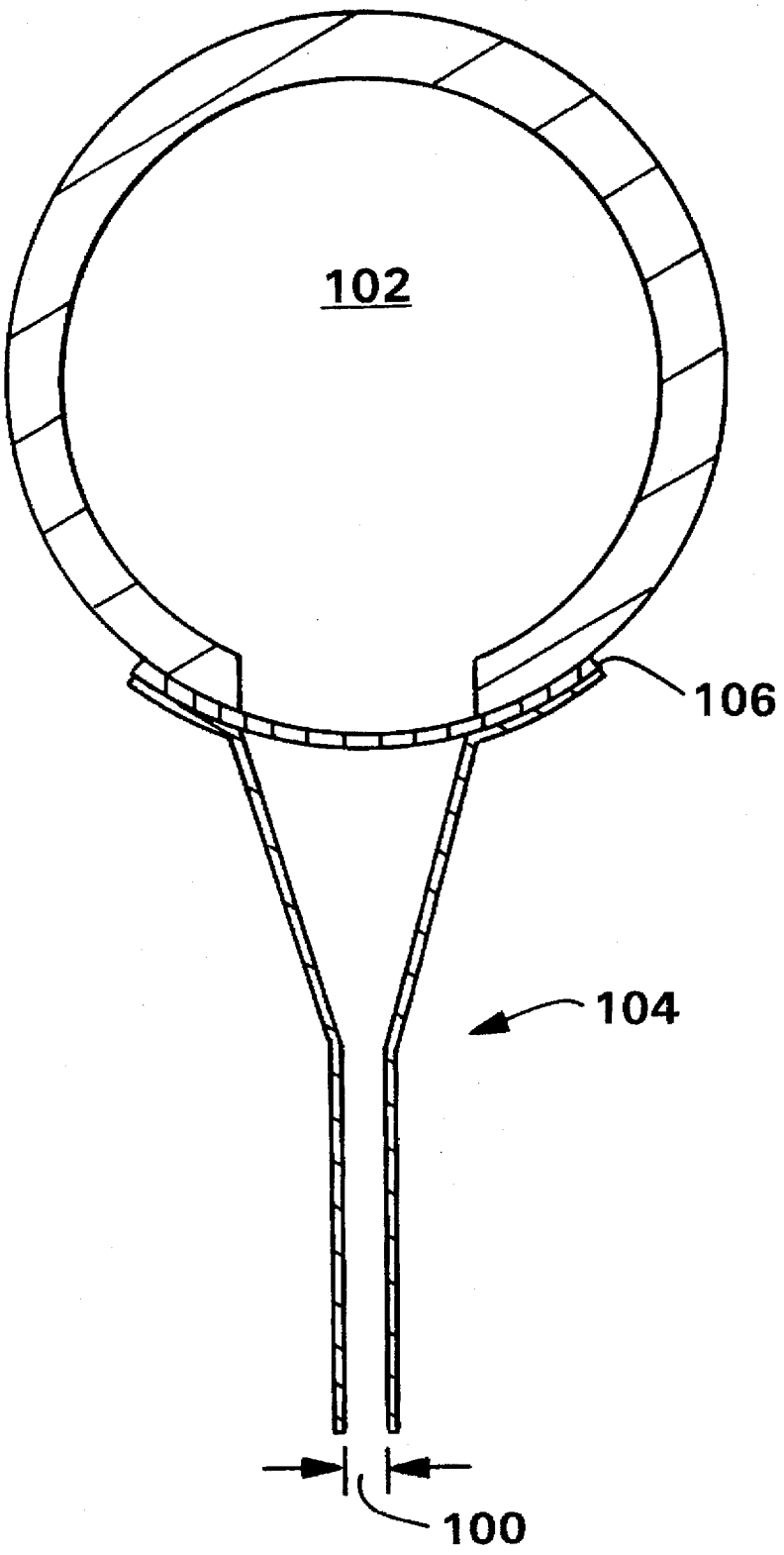
FIG. 2 provides a cross-sectional view of the hot air knife.

One embodiment of a HAK is shown schematically in FIG. 2. The HAK has a plenum 102 to receive, contain and distribute heated air which continuously flows into it from an external source. As such, it may be a variety of sizes and shapes. The plenum 102 shown in FIG. 2 is a stainless steel cylinder, or pipe. The dimensions of the plenum can be varied. The plenum pressure of the HAK may be between 1.0 and 64.0 inches of water (2 to 119 mm Hg), preferably between 5.0 and 7.0 inches of water (9–13 mm Hg).

As air flows continuously into the plenum, it is forced out a tailpipe with a divergence 104, which is attached to the plenum with a steel plate 106. The pressure of the air drops upon entering the tailpipe with divergence. The tailpipe ends in the rectangular slot 100 through which the air jet is emitted. The rectangular slot is about ⅛ to 1 inch (3 to 25 mm) in width, preferably approximately ½ inch (12.7 mm). The length of the rectangular slot runs in the cross machine direction over substantially the entire width of the nonwoven fabric. Thus, the length of the rectangular slot can be varied as desired and need not exactly match the dimensions of the nonwoven fabric, although it is preferable that the orifice of the HAK be at least as long as the width of the nonwoven fabric.

In an alternative embodiment, there may be a plurality of rectangular slots arranged next to one another lengthwise, but separated by a slight gap. Moreover, the rectangular shape of the orifice is not essential; circular or other shaped holes could optionally be used. In another alternative embodiment, fluids other than air, such as nitrogen gas, steam or water, for example, may be used.

In a preferred embodiment, the HAK is positioned vertically above and nearly perpendicular to the nonwoven fabric on the transfer belt, as shown in FIG. 1. The angle preferably varies from perpendicular to the web surface by no more than 15 degrees, more preferably no more than 10 degrees in order to transfer energy most effectively to the web. The HAK may be between approximately 0.25 to 10 inches (6.4 to 254 mm) above the transfer belt, and preferably 1 inch (25.4 mm) above.

Since the transfer belt on which the nonwoven fabric is transported typically moves at a high speed, the time of contact of any specific part of the web with the air jet emitted from the HAK is generally between 1/10 and 1/100 of a second. Because the speed of the transfer belt can be varied, the time of exposure of the fabric to the HAK air can be controlled as well.

In a preferred embodiment of the present invention, the flakes resulting from the process disclosed above may be incorporated with first-use polymer resin and used to make a new nonwoven mat, such as by a meltblowing, spunbonding or carding process. It would be possible to produce and use such a web as if it were made with 100% first-use polymer resin. For example, the flakes and first-use polymer resin could be used to make biconstituent fibers in a meltblowing process. Any process or application known in the art involving first-use polymer resin could be applied to a mixture of first-use polymer resin and the flakes of the present invention including, but not limited to, webs made by a meltblowing, spunbonding or carding process. The flakes can also be used to make films. Such techniques are well known to those skilled in the art.

Furthermore, the means by which the initial mat was made does not dictate the use of the resultant flakes. If the initial mat is a film or otherwise nonporous, it should be perforated or otherwise treated as by shredding or the like to provide the necessary flow through the web to obtain heat transfer throughout.

The invention will be further described in the following examples. It should be understood, however, that the examples are given for purposes of illustration and should not limit the scope of the invention.

EXAMPLES

Example I

A roll of 0.4 osy (14 gsm) spunbond material made from polypropylene (m.p. 340° F., 171° C.) was employed in the apparatus illustrated in FIG. 1. A HAK according to that shown in FIG. 2 was used, the plenum being a pipe 4 inches in diameter and 18 inches long. The HAK was positioned 1 inch (2.54 cm) above the transfer belt, and supplied air at a 90° angle to the web and a temperature of 360° F. (182° C.), a pressure of 4 inches (10.15 cm) of water, and a flow rate of about 9.500 feet per minute (2,895.6 meters per minute). The exit slot of the tailpipe was ⅜ inch (0.95 cm) in width and 20 inches (51 cm) in length. The web was successfully broken into flakes under these conditions.

Example II

According to a preferred embodiment of the present invention, the flakes produced in Example I would be incorporated into the spinning system with first-use polymer. The flakes and first-use polymer would be blended together in the extruder and used as any first-use polymer resin would commonly be employed. For example, a 2:98 ratio by weight of flakes:first-use polypropylene resin could be used to make a spunbond fabric according to conventional spunbonding technology.

Although the invention has been described in detail with respect to specific embodiments thereof, it should be appreciated that those skilled in the art may conceive alterations to, variations of and equivalents to these embodiments. Accordingly, the scope of the present invention should be assessed as that of the appended claims and any equivalents thereto.

What is claimed:

1. A method of reducing a thermoplastic nonwoven web to flakes, comprising:

a) providing means for forming a heated fluid jet;

b) feeding said nonwoven web onto a transfer belt positioned in the path of said heated fluid jet;

c) contacting said nonwoven web with said heated fluid at an angle within about 15° of perpendicular to the web surface to reduce said web to flakes having an average equivalent diameter between about one-sixteenth inch to about one-eighth inch and an average thickness between about $1/3000^{th}$ to about $1/10{,}000^{th}$ inch; and d) applying vacuum to draw said fluid through said web.

2. The method of claim 1, wherein said heated fluid jet is air provided by a hot air knife.

3. The method of claim 2, wherein said hot air knife is used at temperatures in the range of from about 0° to about 130° F. (0° to 72° C.) above the melting point of said web.

4. The method of claim 2, wherein said hot air knife is used at plenum pressures in the range of 1.0 to 64.0 inches of water (2 to 119 mm Hg).

5. The method of claim 2, wherein said hot air knife is positioned between 0.25 and 10 inches (6.4 to 254 mm) away from said nonwoven web.

6. The method of claim 2, wherein said hot air knife is within 5 to 10 degrees of perpendicular to said nonwoven web.

7. The method of claim 2, wherein said hot air knife supplies a jet of air at a rate in the range of 1,000 to 12,000 feet per minute (305 to 3658 meters per minute).

8. The method of claim 2, wherein said flakes are removed from the transfer belt by a brush and collected.

9. The method of claim 2, wherein said nonwoven web is selected from the group consisting of spunbond fabrics, meltblown fabrics and bonded carded webs.

10. The method of claim 2, wherein said nonwoven web is comprised of fibers selected from the group consisting of polyolefins, polyesters and polyamides, and blends thereof.

11. The method of claim 2, wherein said nonwoven web comprises polyethylene, polypropylene or poly(ethylene terephthalate) fibers.

12. The method of claim 2, wherein said web comprises bicomponent fibers of at least one component selected from the group consisting of polyolefins, polyesters and polyamides.

13. The method of claim 2, wherein said web comprises biconstituent fibers of at least one constituent selected from the group consisting of polyolefins, polyesters and polyamides.

14. The method of claim 2, wherein said web is a composite material.

15. The method of claim 2, wherein said web comprises a film.

16. The method of claim 2, wherein said flakes are collected and reprocessed.

17. The method of claim 1, wherein said heated fluid jet is selected from the group comprised of nitrogen gas, steam, or water.

* * * * *

UNITED STATES PATENT AND TRADEMARK OFFICE

CERTIFICATION OF CORRECTION

PATENT NO. : 5,687,916

DATED : November 18, 1997

INVENTOR(S): Romano, III et al.

It is certified that errors appear in the above-identified patent and that said Letters Patent is hereby corrected as shown below:

Column 4, line 8, "am" should read --are--;
Column 9, line 1, "9.500" should read --9,500--.

Signed and Sealed this

Twenty-fifth Day of August, 1998

*Attest:*

*Attesting Officer*

BRUCE LEHMAN

*Commissioner of Patents and Trademarks*